US007232126B2

(12) United States Patent
Drago et al.

(10) Patent No.: US 7,232,126 B2
(45) Date of Patent: Jun. 19, 2007

(54) OVER THE RACEWAY DIVERT DEVICE, SYSTEM AND METHOD FOR DIVERTING SUSPECT DOCUMENTS

(75) Inventors: Michael Drago, Bethlehem, PA (US); Edward Otto, Fredericksburg, VA (US)

(73) Assignee: Bowe Bell + Howell Company, Durham, NC (US)

( * ) Notice: Subject to any disclaimer, the term of this patent is extended or adjusted under 35 U.S.C. 154(b) by 287 days.

(21) Appl. No.: 11/023,964

(22) Filed: Dec. 29, 2004

(65) Prior Publication Data

US 2006/0157925 A1 Jul. 20, 2006

(51) Int. Cl.
*B65H 39/06* (2006.01)
*B07C 9/00* (2006.01)

(52) U.S. Cl. ..... 271/303; 271/298; 209/657; 209/900

(58) Field of Classification Search ..... 271/298, 271/303, 184; 209/584, 656, 657, 900
See application file for complete search history.

(56) References Cited

U.S. PATENT DOCUMENTS 3,310,304 A * 3/1967 Foias et al. ..... 101/234
3,757,942 A * 9/1973 Gunn ..... 209/3.3
3,768,644 A * 10/1973 Di Frank et al. ..... 209/559
3,984,094 A * 10/1976 Stocker ..... 271/303
4,026,540 A 5/1977 Lawrence et al.
4,223,882 A 9/1980 Stocker
5,321,624 A 6/1994 Helffrich et al.
5,877,699 A * 3/1999 Sharpe et al. ..... 340/7.54
5,913,514 A 6/1999 Moser et al.
6,032,953 A 3/2000 Otto et al.
6,045,323 A * 4/2000 Achelpohl et al. ..... 414/790.8
6,076,683 A 6/2000 Okada et al.

FOREIGN PATENT DOCUMENTS

DE 2 229 414 A1 1/1974
DE 36 09 148 A1 10/1986

* cited by examiner

*Primary Examiner*—Patrick Mackey
*Assistant Examiner*—Kaitlin Joerger
(74) *Attorney, Agent, or Firm*—McDermott Will & Emery LLP

(57) ABSTRACT

The present subject matter relates to the field of document material handling in high-speed in-line mailing systems. In particular, the present subject matter relates to a cross track divert device, system and method for diverting a suspect or invalid document from a paper pathway prior to the document entering a raceway conveyor. The cross track divert device is designed to divert and remove the suspect or invalid document without stoppage of the mailing system's operation cycle.

17 Claims, 6 Drawing Sheets

OVER THE RACEWAY DIVERT DEVICE, SYSTEM AND METHOD FOR DIVERTING SUSPECT DOCUMENTS

TECHNICAL FIELD

The present subject matter relates to the field of document material handling in high-speed in-line mailing systems. More particularly, the present subject matter relates to an improved divert device and method for diverting a suspect or invalid document from a paper pathway prior to the document entering onto a raceway conveyor.

BACKGROUND

Various high-speed in-line mailing systems and methods have been employed in the past for processing of sheet material or articles such as paper sheets, documents, and the like. Such high-speed in-line mailing systems prepare mailable articles such as bills, account statements, etc. High-speed in-line mailing systems process and prepare the mailable articles with a plurality of devices selected from cutters, register tables, accumulators, folders, collectors, and inserters.

In known mailing systems, a series of groups of documents are accumulated from a web of sheet material on which individual sheets are pre-printed. The web of sheet material can include indicia pre-printed in at least one disposable margin of a control document for each group of documents. A reader accepts sheet material and reads for each group the pre-printed indicia. The pre-printed indicia contain coded instructions for processing the group associated with the control document on which the indicia are printed. Such instructions include, for example, the number of and order of sheets in a particular group. The reader may comprise an optical mark reader, a bar-code reader, or other known indicia-reading devices. Instructions read by the reader are passed to a central processor, where they are used to control processing equipment downstream from the reader. A control panel is provided for allowing operator-control of basic functions, such as start, stop, run, jog, and reset.

The web of sheet material then passes through a cutter which cuts the continuous web into a series of individual sheets. The sheets are then fed to an accumulator, which accumulates a stream of sheets in a stack until the last sheet to be associated with the stack is delivered thereto, at which time the completed stack is ejected and accumulation of the next stack begins. The number and order of sheets in an individual stack are controlled by the accumulator according to instructions read by the reader from the control document.

The stack of documents ejected from the accumulator are accepted by a folder, which folds a stack into letter size (i.e. two-fold, tri-fold, etc.) and deposits into collector. The collector, once it has received a proper number of folded completed sets according to the instructions read from the control document, delivers the completed set of documents onto a track. The track is often a conventional raceway conveyor for delivery of the completed sets.

A completed set of documents first passes an in-track detector which senses the presence of the completed set in the track and sends a document-in-track signal to a microprocessor as a control signal for control of processing along the track. The in-track detector may comprise a photocell or other conventional sensing device. A CRT and keyboard can be provided adjacent the track for allowing a machine operator to interface with the machine. The completed set then passes a series of detectors, including infrared-type. Each detector senses whether the group contains more than a certain preset number of documents. The detectors are each preset to successive trip-levels, and each detector is tripped if the number of documents in a passing group is higher than that detector's preset trip level. The microprocessor receives signals from the detectors and from the reader, and compares those signals to determine whether the number of documents as measured by the detectors exceeds the expected number in that group as read by the reader from the group's control document. If the measured number exceeds the expected number, the microprocessor performs a series of steps which allow for correction of the error.

Upon detecting an error condition, the microprocessor executes a machine fault, thereby halting the machine cycle, and sends an error signal to the CRT, the error signal serving to alert the machine operator of the error and to convey information such as the expected number and the measured number. When the error has been cleared by the machine operator, the operator removes the error from machine fault mode by actuating a switch on the control panel, thereby restarting the machine cycle. In other known methods, the central processor does not halt the machine cycle upon detection of an excess in the number of documents, but rather sends a signal to an error-remediation mechanism downstream from the detectors. The error-remediation mechanism may comprise a divert mechanism for diverting the group-in-error to a divert area for error remediation. The latter method allows for uninterrupted machine operation.

A complete set traveling along the track passes one or more insert processing stations. Each of these stations selectively adds inserts to a group in a known manner according to various criteria, and may comprise "gripper-arm" type inserters or other known inserters. The group of documents is inserted into an awaiting envelope at an insertion station, after which the envelope flap is closed at a flap closer. The closed envelope is turned over and deposited onto a delivery table for removal from the machine.

In other known mailing systems, a stack of documents ejected from the accumulator are accepted by a folder, which folds a stack into letter size and deposits it into a collector. The collector, once it has received a proper completed set according to the instructions read from the control document, delivers the completed set of documents onto a raceway conveyor by way of a series of polycords. At a position upstream to the raceway conveyor, a pneumatically activated sheet metal gate is incorporated. The pneumatically driven sheet metal gate is activated following detection of an error in the group. The pneumatically activated sheet metal gate diverts the group-in-error to a divert area over the raceway conveyor. The divert area can be a Plexiglas cover over the raceway that is mounted inverted to act as a catch bin. This known pneumatically activated sheet metal gate allows for uninterrupted system operation.

Accordingly, there remains room for improvement in the art for a divert device and method for deflecting invalid or suspect documents out of a paper pathway prior to their entry onto a raceway conveyor. The divert device should effectively and efficiently remove invalid or suspect documents without having to stop the cycle of the mailing system, thereby increasing productivity.

SUMMARY

It is desirable to provide a cross track divert device for deflecting suspect documents above and across a raceway conveyor. The cross track divert device comprises opposing first and second side supports pivotally mounted into or out of operational position relative to an underlying raceway conveyor. A plurality of divert fingers are fixed to a rotatable shaft centered between the opposing first and second side supports. A selective actuator mechanism is provided for rotating the shaft and driving the plurality of divert fingers such that the suspect document is deflected over the plurality of divert fingers.

In accord with the present concepts disclosed herein, there is provided a method for diverting a moving suspect document above and laterally across a raceway conveyor. The method comprises the step of detecting a moving suspect document in a paper pathway prior to its entry onto a raceway conveyor, wherein the moving suspect document enters the raceway conveyor from the paper pathway in a lateral direction. A selective actuator mechanism is signaled to activate and cause a shaft to rotate and drive a plurality of divert fingers, fixed thereto, from a position over the raceway conveyor to a position in which leading edges of the divert fingers are in the paper pathway. The suspect document is deflected over the plurality of divert fingers and above and laterally across the raceway conveyor. In certain embodiments, the suspect document is deposited into a divert area such as catch bin or, more preferably, a static collection bin.

An additional advantage of the present subject matter is a cross track divert system for deflecting suspect documents above and laterally across a raceway conveyor. The cross track divert system comprises a sensor for detecting a document traveling in a paper pathway. A controller is provided for determining whether the document is compliant with one or more predetermined set of conditions. A plurality of divert fingers are mounted on a rotatable shaft and activated by a selective actuator mechanism. The controller signals the selective actuator mechanism to activate when the document is identified as a suspect document. The selective actuator mechanism then drives the plurality of divert fingers from a position over the raceway conveyor to a position in which leading edges of the divert fingers are in the paper pathway. This permits the suspect document to deflect over the plurality of divert fingers and above and laterally across the raceway conveyor.

Additional advantages and aspects of the present subject matter will become readily apparent to those skilled in the art from the following detailed description, wherein embodiments of the present subject matter are shown and described, simply by way of illustration of the best mode contemplated for practicing the present subject matter. As will be described, the present subject matter is capable of other and different embodiments, and its several details are susceptible of modification in various obvious respects, all without departing from the spirit of the present subject matter. Accordingly, the drawings and description are to be regarded as illustrative in nature, and not limitative.

BRIEF DESCRIPTION OF THE DRAWINGS

The following detailed description of the embodiments of the present subject matter can best be understood when read in conjunction with the following drawings, in which the various features are not necessarily drawn to scale but rather are drawn as to best illustrate the pertinent features, and in which like reference numerals are employed throughout to designate similar features.

DETAILED DESCRIPTION

Figure 1:
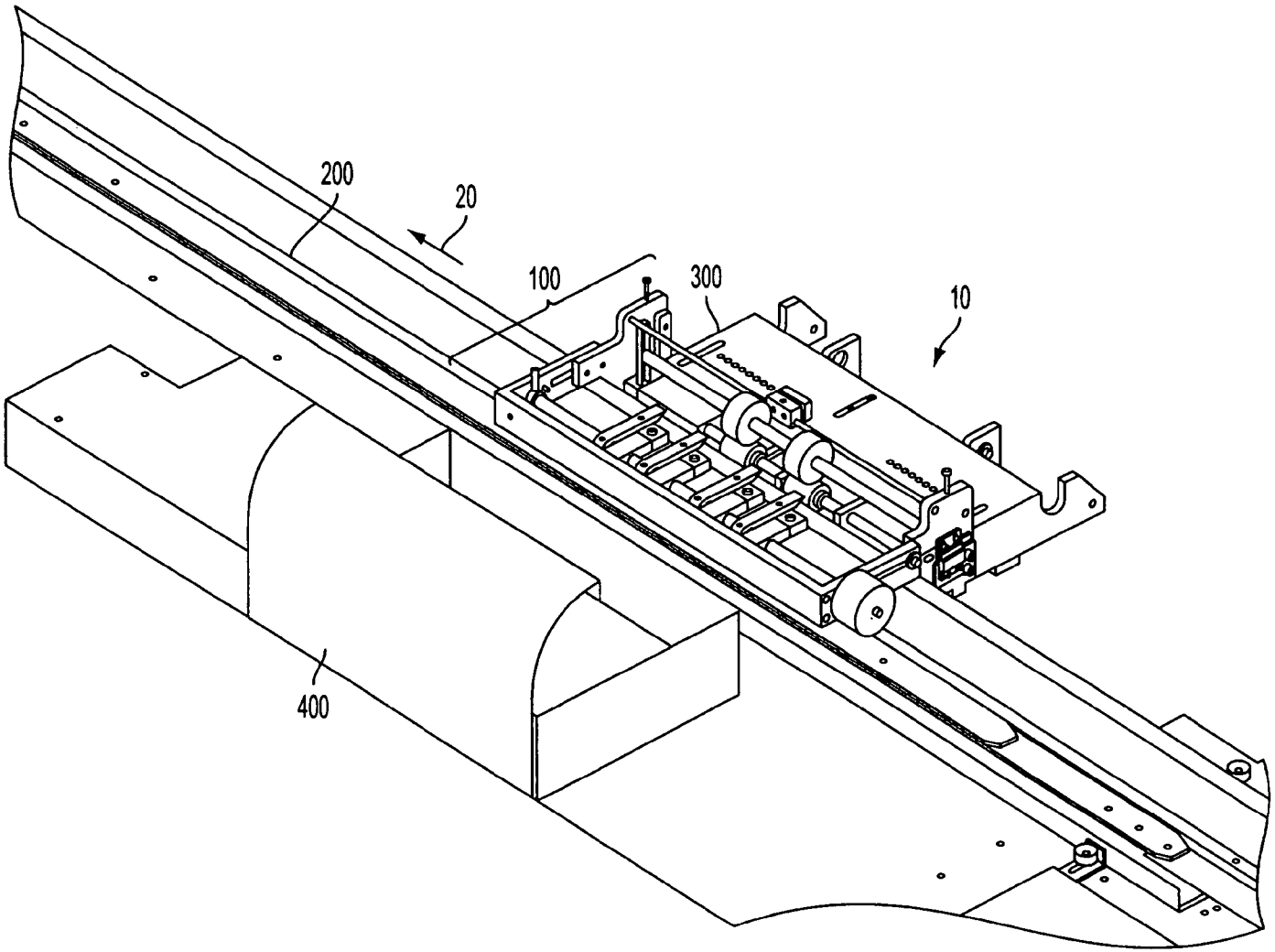
FIG. 1 of the drawings is a simplified, isometric, partially-schematic, diagram of a first example of a cross track divert device.

A first example of a cross track divert device 100 in accord with the present concepts is disclosed and shown by way of FIG. 1. The presently disclosed cross track divert device as shown in FIG. 1 is fastened on a collector 300 and positioned over a raceway conveyor 200. The basic operation, structure, software and control features of the collector 300 and raceway conveyor 200 are well known to those skilled in the art and are omitted herein for brevity. During a normal operation cycle of a high speed in-line mail system, stacks of documents ejected from an accumulator (not shown) are accepted by a folder (not shown), which folds the set into letter size or other folded configurations and deposits it with collector 300 from direction arrow 10. Collector 300, once it has received a complete set, laterally delivers the completed group of documents onto raceway conveyor 200 for delivery of the complete set downstream to an inserter (not shown) in the direction of arrow 20. During the normal operation cycle of a high speed in-line mail system, collector 300 will deposit the completed set of documents onto raceway conveyor 200, located below the cross track divert device 100. However, upon detection of a suspect or invalid document, the cross track divert device 100 is activated and will divert the suspect/invalid document over and across the raceway conveyor 200 and into collection bin 400. A more complete description of the activation of the cross track divert device 100 is described below.

Figure 2:
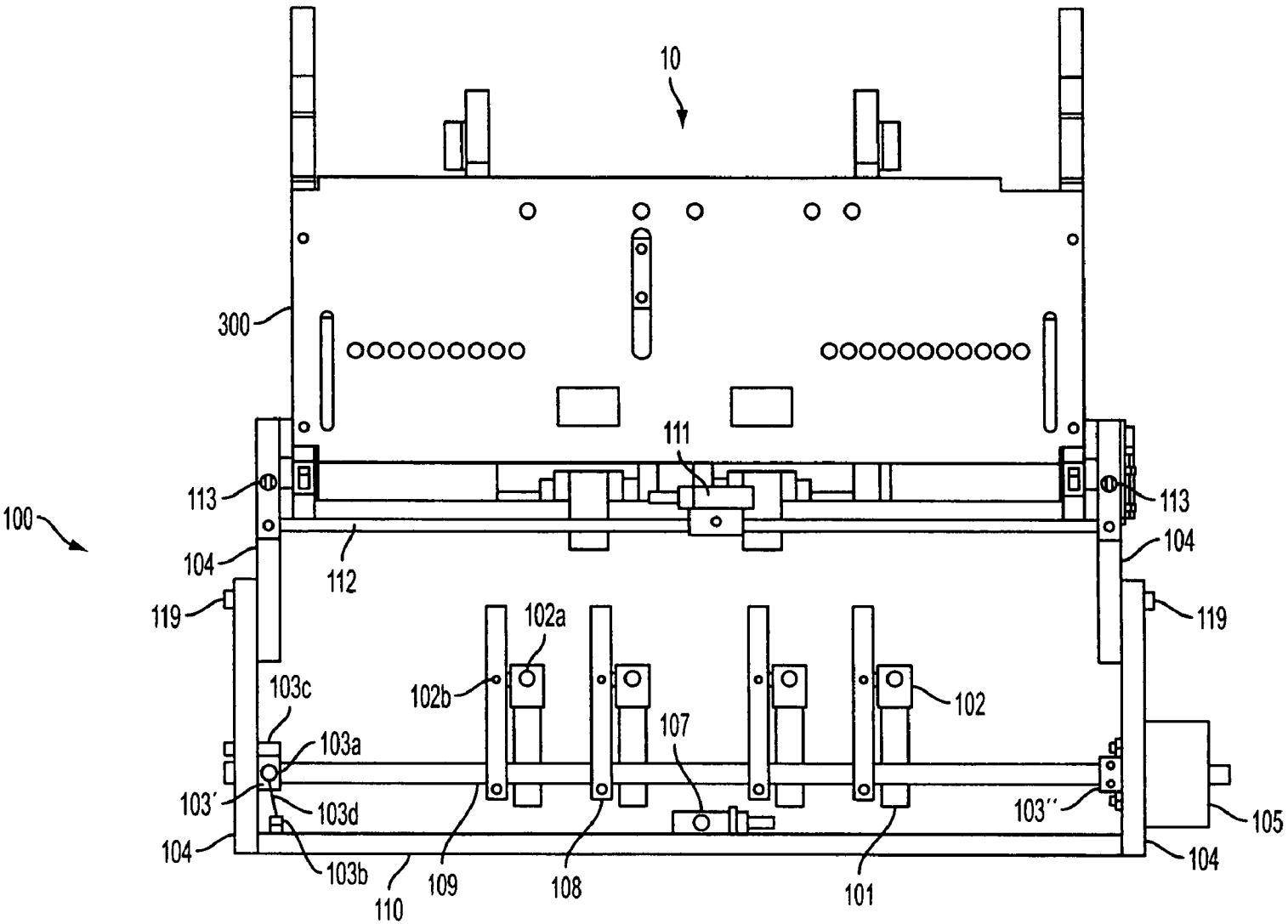
FIG. 2 of the drawings is a top plan view of the cross track divert device.
Figure 3:
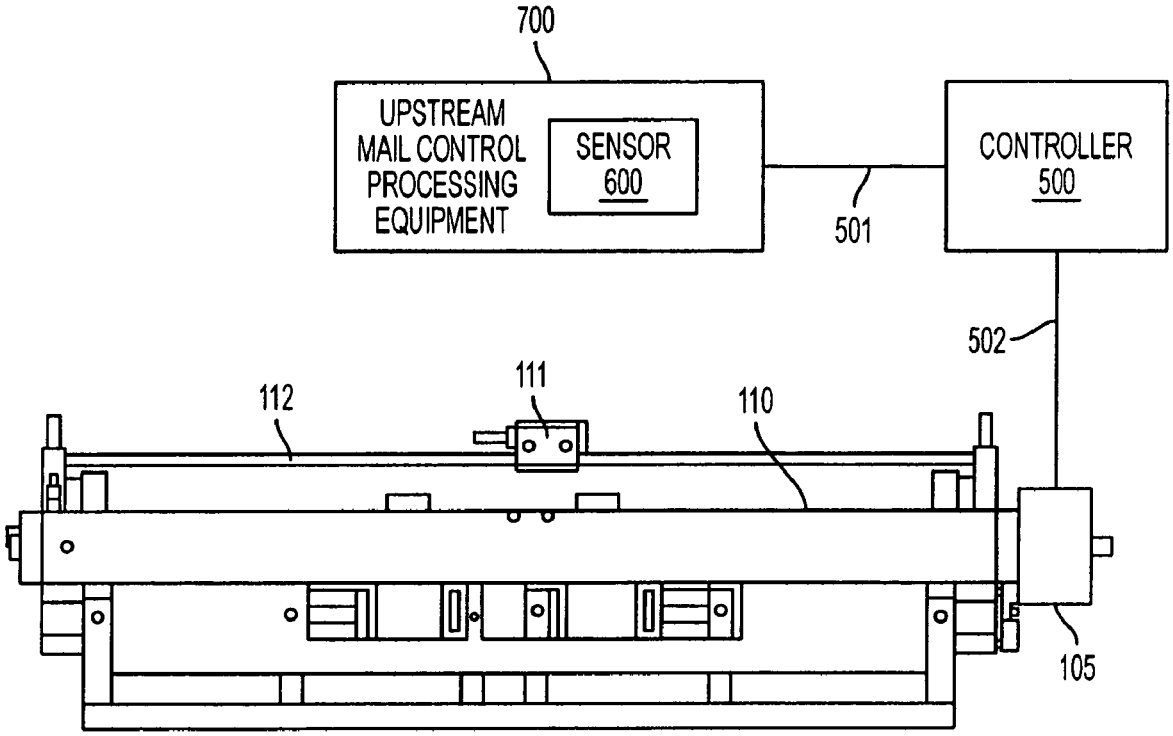
FIG. 3 of the drawings is a front plan view of the cross track divert device.
Figure 4:
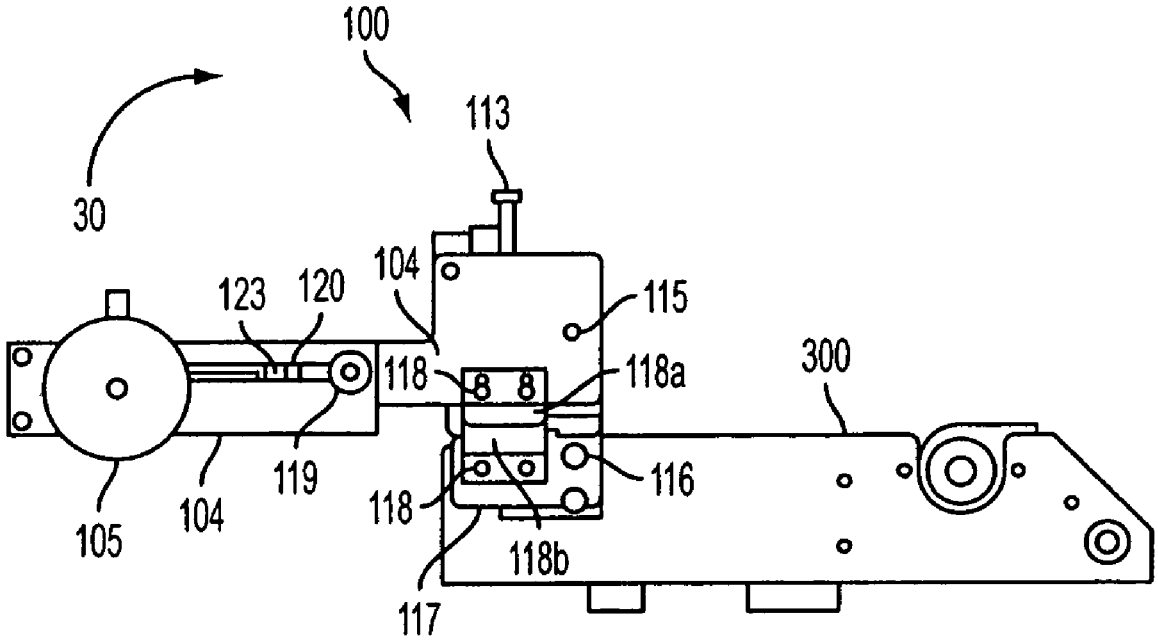
FIG. 4 of the drawings is a side plan view of the cross track divert device.

The cross track divert device 100 is further illustrated in FIGS. 2, 3 and 4. FIG. 2 of the drawings is a top plan view of the cross track divert device 100. The cross track divert device 100 includes opposing first and second side supports 104. As shown in FIG. 4, the opposing first and second side supports 104 are secured to the collector 300 with screws 116 which also secure an interlock mounting plate 117. As shown in FIG. 4, interlock mounting plate 117 includes upper interlock 118*a* and lower interlock 118*b* with fastening screws 118. The upper interlock 118*a* needs to be in contact with the lower half 118*b* for machine operation. If the magnetic interlock between upper interlock 118*a* and lower interlock 118*b* is broken or the divert device 100 is rotated upward the machine will not operate. This interlock mechanism insures complete machine operation.

In FIG. 2, the opposing first and second side supports 104 are designed such that they can be extended in a lengthwise (horizontal) direction across the underlying raceway conveyor 200. A conventional mechanical connection means 119 is provided so that the length of the first and second side supports 104 can be adjusted horizontally. As depicted in FIG. 2, the mechanical connection means 119 includes a socket head cap screw with washer. The shaft of the screw passes through a slot in the side support 104, and the threads engage a threaded hole in or a nut on the opposite side support 104. The mechanical connection means 119 can be adjusted such that the opposing side supports 104 can be moved horizontally in order to shorten or increase the distance that the side supports 104 extend over and across raceway conveyor 200. Metal support pin 120 is fixed to the side support 104 and extends into a horizontal slot 123. The combination of the metal pin 120 and the mechanical connection means 119 provide horizontally spaced support for the side supports 104.

The cross track divert device 100 further includes a leveling screw 113 for horizontally leveling the cross track divert device over the raceway conveyor 200. The leveling screw 113 is adjusted (turned) so the complete divert device rotates about pivot point 115.

Forward support plate 110 holds the opposing side supports 104 together. Forward support plate 110 and opposing side supports 104 are fastened together via a conventional mechanical connection means. Rotatable shaft 109 is connected to opposing side supports 104 with opposing clamping collars 103' and 103". Spring pin 103*b* is connected to forward support plate 110 and a spring pin 103*a* is connected to clamping collar 103'. A spring 103*d* connects spring pins 103*a* and 103*b*. Spring 103*d* assists in returning the plurality of divert fingers 108 to a horizontal position. Clamping collar 103' and spring pin 103*a* also act as a biasing element for the rotatable shaft 109. The screw 103*c* acts as a stop for the plurality of divert fingers 108. Spring pin 103*a* will come in contact with screw 103*c* to stop the rotation of the plurality of divert fingers 108 during operation of the divert device 100.

As shown in FIG. 3, upstream mail control processing equipment 700, including but not limited to a cutter, accumulator, folder or collector, is equipped with one or more sensor devices 600 associated with a microprocessor based controller 500 or the like. Sensor device 600 is a conventional photocell, infrared-type or other conventional sensing device that is capable of detecting such preset conditions including limit errors, read errors, integrity errors and handling errors. As a non-limiting example, sensor device 600 is connected to upstream mail control processing equipment 700, such as an accumulator. Sensor 600 is preset to successive trip-levels, and the sensor is tripped if the number of documents in a passing group is higher than sensor's 600 preset trip level. Microprocessor based controller 500, receives a signal from sensor device 600 through wiring 501 and determines whether the number of documents as measured by sensor device 600 exceeds the expected number in that group. If the grouping of documents, as measured by sensor device 600, are suspect or invalid, then the cross track divert device 100 is signaled by way of wiring 502 and the cross track divert device 100 is activated to deflect the suspect or invalid documents out of the paper pathway and into collection bin 400.

Adverting to FIG. 2, a plurality of divert fingers 108 are fixed to rotatable shaft 109 centered between the opposing side supports 104. Rotatable shaft 109 is connected to opposing side supports 104 with clamping collars 103. Each divert finger 108 has connected thereto, a knock-down brush 101. Knock-down brushes 101 are connected to divert fingers 108 via rotatable shafts 102 with screws 102*a*. Knock-down brushes 101 are adjustably positioned below the rotatable shaft 109 towards the paper pathway via set screws 102*b*. During the normal operation cycle of a high speed in-line mail system, collector 300 will deposit the completed set of documents onto raceway conveyor 200. Knock-down brushes 101 are rotatably mounted such that they assist with deflecting the group of documents down onto the raceway conveyor 200.

Interposed between the opposing side supports 104 is an overhead shaft 112 which includes a sensor 111 mounted on the overhead shaft 112. Sensor 111 includes a conventional photocell, infrared-type or other conventional sensing device. A sensor 107 mounted on forward support plate 110 to ensure that any grouping of documents that is diverted over sensor 107 and into collection bin 400 is accounted.

FIG. 4 is a side plan view of the cross track divert device 100 according to the present subject matter. The opposing side supports 104 are pivotally mounted to allow the cross track divert device 100 to pivot up and away from the raceway conveyor 200, in the direction of arrow 30, around pivot point 115. The opposing side supports 104 are pivotally mounted into or out of operational position relative to the underlying raceway conveyor 200. Pivot point 115 allows for easy access to portions of the raceway conveyor 200 below the cross track divert device 100 and facilitates maintenance and repairs. Moreover, access to jammed or obstructed documents in the paper pathway is improved by having the pivot point 115 included with the cross track divert device 100.

As discussed previously, if a set of documents, as measured by sensor device 600, are suspect or invalid, then the cross track divert device 100 is activated to deflect the suspect or invalid documents out of the paper pathway and into collection bin 400. As an example, microprocessor based controller 500 receives signals from sensor 600 through wire 501 and microprocessor based controller 500 computes whether the number of documents as measured by sensor 600 exceeds the expected number in that grouping of documents. Microprocessor based controller 500 will then send a signal through wiring 502, to selective actuator mechanism 105. The selective actuator mechanism 105, as depicted in FIG. 3, is mounted one of the side supports 104.

Figure 5:
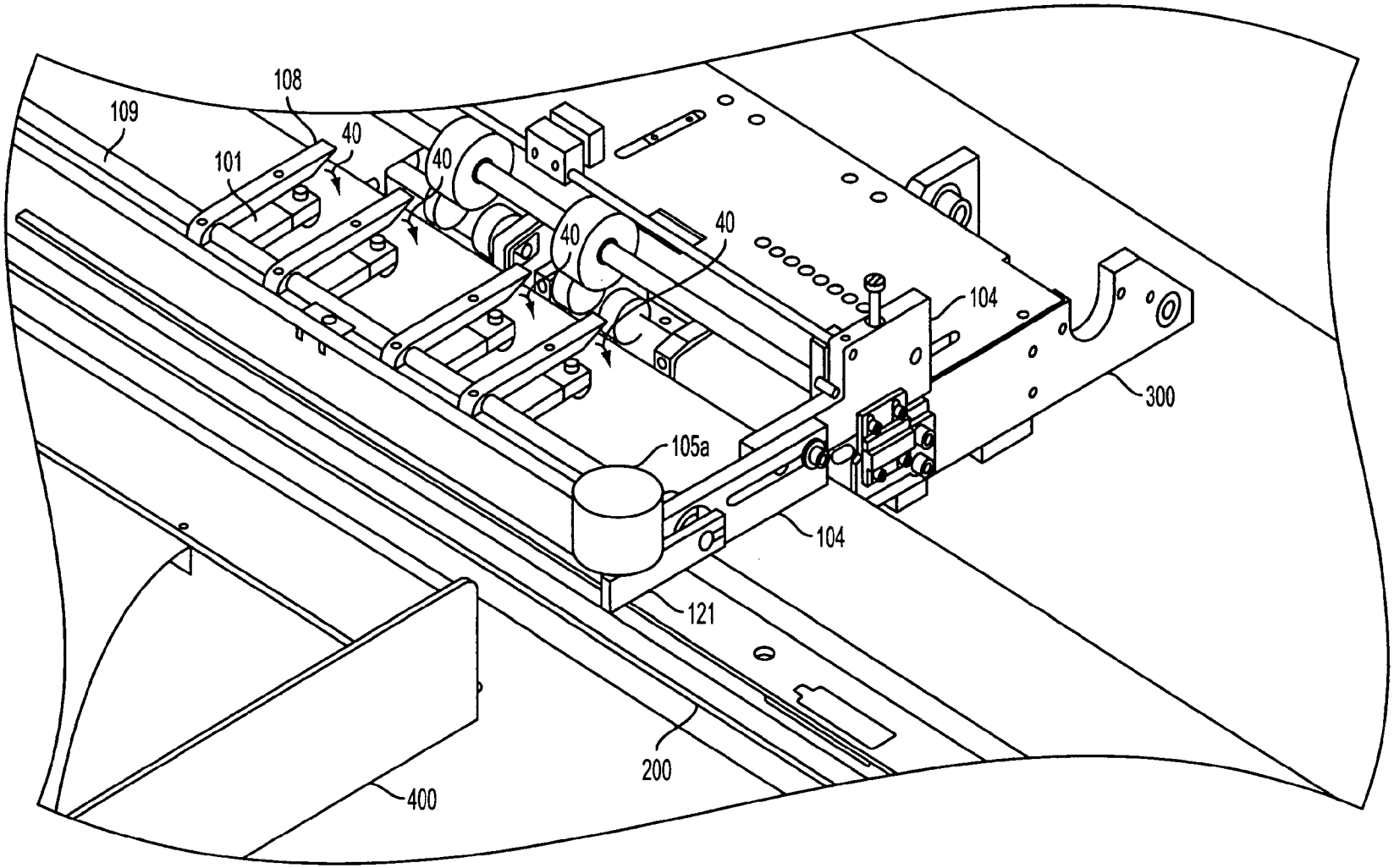
FIG. 5 of the drawings illustrates a plan view of another example of a cross track divert device showing a mounted selective actuator mechanism.

As depicted in FIG. 2, mechanism 105 is an electric solenoid. In other embodiments, as shown in FIG. 5, a push-pull electric solenoid 105*a* with lever arm 121 is illustrated. Further, in FIG. 6, an air actuated cylinder 105*b* with lever arm 122 is illustrated. The electric solenoid 105, the push-pull electric solenoid 105*a* and the air actuated cylinder 105*b*, are each selective actuator mechanisms. These three mechanisms, when activated, will drive the plurality of divert fingers 108 from a first position to a second position into the paper pathway, permitting the moving suspect or invalid document group to deflect over the plurality of divert fingers 108, above and across the raceway conveyor 200, and into collection bin 400. With each of the three mechanisms (105, 105*a*, and 105*b*), microprocessor based controller 500 will send a signal through wiring 502, to activate the actuator mechanism mounted on one of the side supports 104.

Figure 6:
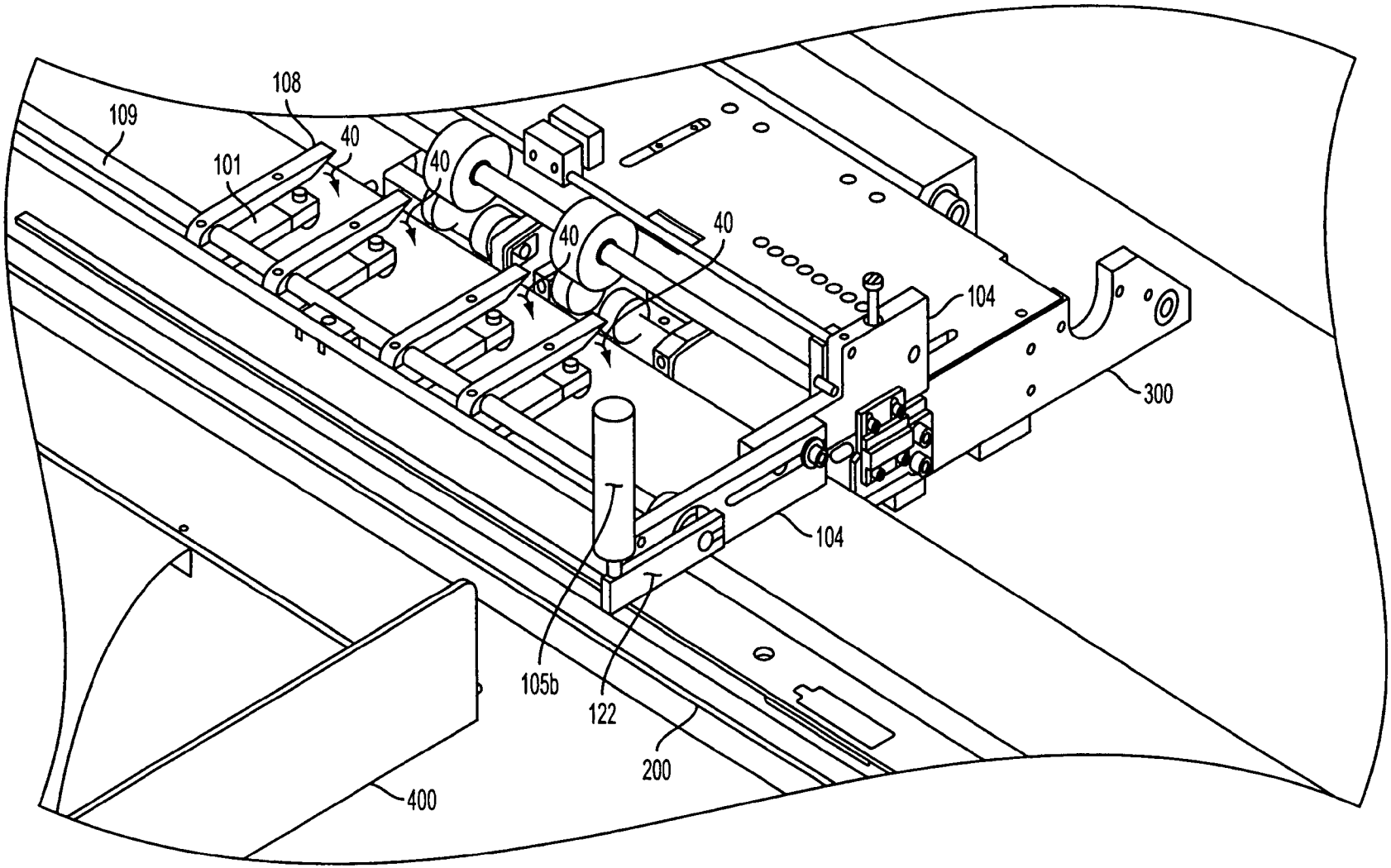
FIG. 6 of the drawings illustrates a plan view of another example of a cross track divert device showing a mounted selective actuator mechanism.

Once activated, each of the actuator mechanisms will cause the rotatable shaft to rotate and move the divert fingers from a first substantially horizontal position to a second position in the downward direction of arrow 40 toward the paper pathway, as depicted in FIGS. 5 and 6. In the second position, the approximate angle of the divert fingers is sufficient to deflect the moving suspect or invalid document group over the plurality of divert fingers 108, above and across the raceway conveyor 200, and into collection bin 400. In other words, the selective actuator mechanism is activated and causes the rotatable shaft 109 to rotate and drive the plurality of divert fingers 108, fixed thereto, from a first position over the raceway conveyor 200 to a second position in which leading edges of the divert fingers 108 are in the paper pathway. Thus, the moving suspect document is deflected over the plurality of divert fingers 108 and above and laterally across the raceway conveyor 200. As a non-limiting example, the approximate angle of the divert fingers in the second position is about 20 to about 40 degrees, more preferably 30 degrees.

The selective actuating mechanisms of the present concepts are not limited to the foregoing and can be a roller screw actuator, electromechanical actuator, mechanical actuator, linear actuator, rotary actuator, motor-operated actuator, or any other conventional actuator which is capable of rotating rotatable shaft 109 such that divert fingers 108 may be moved from a first relatively horizontal position to a second position near the paper pathway. For example, in various aspects, the selective actuator mechanism may only generate a positive driving force in one direction ("driving stroke"), and the return stroke may be accomplished using a biasing element, such as spring 103*d*, or the converse may be arranged.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter.

Only the preferred embodiments of the present subject matter and but a few examples of its versatility are shown and described in the present disclosure. It is to be understood that the present subject matter is capable of use in various other combinations and environments and is susceptible of changes and/or modifications within the scope of the inventive concept as expressed herein.

What is claimed is:

1. A cross track divert device for deflecting suspect documents above and across a raceway conveyor, the cross track divert device comprising:

opposing first and second side supports pivotally mounted into or out of operational position relative to an underlying raceway conveyor;

a plurality of divert fingers fixed to a rotatable shaft centered between the opposing first and second side supports; and a selective actuator mechanism for rotating the shaft and driving the plurality of divert fingers such that the suspect document is deflected over the plurality of divert fingers.

2. The cross track divert device according to claim 1, wherein the opposing first and second side supports are extendable in a lengthwise direction across the underlying raceway conveyor.

3. The cross track divert device according to claim 1, further comprising a plurality of knock-down brushes adjacent to each of the plurality of divert fingers.

4. The cross track divert device according to claim 1, wherein the selective actuator mechanism is selected from the group consisting of an electric solenoid, a push-pull electric solenoid with lever arm and an air actuated cylinder with lever arm.

5. The cross track divert device according to claim 1, wherein the selective actuator mechanism is mounted to the first or second side support.

6. The cross track divert device according to claim 1, further comprising a leveling screw for horizontally leveling the cross track divert device over the raceway conveyor.

7. The cross track divert device according to claim 1, further comprising at least one sensor selected from a photocell or infrared device.

8. A method for diverting a moving suspect document above and laterally across a raceway conveyor comprising the steps of:

detecting a moving suspect document in a paper pathway prior to its entry onto a raceway conveyor, wherein the moving suspect document enters the raceway conveyor from the paper pathway in a lateral direction;

signaling a selective actuator mechanism to activate and cause a shaft to rotate and drive a plurality of divert fingers, fixed thereto and positioned between two pivotally mounted opposing side supports, from a position over the raceway conveyor to a position in which leading edges of the divert fingers are in the paper pathway; and deflecting the moving suspect document over the plurality of divert fingers and above and laterally across the raceway conveyor.

9. The method according to claim 8, wherein the suspect document is detected with a sensor device connected to an upstream mail control processing equipment, the sensor detecting the presence of the moving suspect document in the paper pathway prior to its entry onto a raceway conveyor.

10. The method according to claim 8, further comprising the step of depositing the suspect document into a collection bin.

11. The method according to claim 10, further comprising detecting the moving suspect document with a second sensor device prior to the suspect document being deposited into the collection bin.

12. The method according to claim 8, wherein the moving suspect document comprises a folded set of one or more pages of a document.

13. A cross track divert system for deflecting suspect documents above and laterally across a raceway conveyor, the cross track divert system comprising:

an sensor connected to an upstream mail control processing equipment for detecting a document traveling in a paper pathway;

a controller for determining whether the document is compliant with one or more predetermined set of conditions; and a plurality of divert fingers mounted on a rotatable shaft, positioned between two pivotally mounted opposing side supports, and activated by a selective actuator mechanism, wherein the controller signals the selective actuator mechanism to activate when the document is identified as a suspect document and the selective actuator mechanism then drives the plurality of divert fingers from a position over the raceway conveyor to a position in which leading edges of the divert fingers are in the paper pathway, permitting the suspect document to deflect over the plurality of divert fingers and above and laterally across the raceway conveyor.

14. The cross track divert system according to claim 13, wherein the sensor device will signal the controller after it detects the suspect document.

15. The cross track divert system according to claim 14, wherein the controller signals the selective actuator mechanism to activate.

16. The cross track divert system according to claim 13, wherein the selective actuator mechanism is selected from the group consisting of an electric solenoid, a push-pull electric solenoid, and an air actuated cylinder.

17. The cross track divert system according to claim 13, further comprising a collection bin, wherein the suspect document is deflected over the plurality of divert fingers and above and across the raceway conveyor and deposited into the collection bin.

* * * * *